US006446454B1

(12) United States Patent
Lee et al.

(10) Patent No.: US 6,446,454 B1
(45) Date of Patent: Sep. 10, 2002

(54) SUCTION MUFFLER FOR COMPRESSOR

(75) Inventors: In Seop Lee; Kwang Hyup An; Hwan Joo Myung, all of Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/836,198

(22) Filed: Apr. 18, 2001

(30) Foreign Application Priority Data

Sep. 28, 2000 (KR) ..... 00-57085

(51) Int. Cl.[7] ..... F25D 19/00
(52) U.S. Cl. ..... 62/296; 181/403; 417/312
(58) Field of Search ..... 62/296; 181/403, 181/229; 417/312

(56) References Cited

U.S. PATENT DOCUMENTS 4,730,695 A * 3/1988 Bar ..... 181/229
4,784,583 A * 11/1988 Bar ..... 181/403
5,199,856 A * 4/1993 Epstein et al. ..... 137/565.34
5,208,429 A * 5/1993 Field ..... 181/229
5,435,700 A * 7/1995 Park ..... 181/403
5,496,156 A * 3/1996 Harper et al. ..... 181/403
5,584,674 A * 12/1996 Mo ..... 181/403

* cited by examiner

*Primary Examiner*—William E. Tapolcai
(74) *Attorney, Agent, or Firm*—Birch, Stewart, Kolasch & Birch, LLP

(57) ABSTRACT

Suction muffler for a compressor including an inlet for introducing a refrigerant into the suction muffler, a chamber for temporary storage of the refrigerant and dropping a pressure of the refrigerant by means of a sudden increase of a volume of the refrigerant, a resonator for attenuating a noise of a specific frequency, a refrigerant supply tube for leading the refrigerant from the chamber to a cylinder, thereby stopping transmission of a pulsating flow occurred by the piston movement in the cylinder to outside of the refrigerant supply tube and preventing transmission of a noise from a suction valve and a discharge valve to outside of the suction muffler, wherein the chamber includes a vibration member having a vibration frequency corresponding to a pulsation frequency occurred at the refrigerant supply tube, thereby increasing supply of refrigerant to the cylinder a improving a performance of the compressor.

9 Claims, 6 Drawing Sheets

SUCTION MUFFLER FOR COMPRESSOR

BACKGROUND OF THE INVENTION

1. Field of the Invention

The present invention relates to a compressor, and more particularly, to a suction muffler for a compressor, which can provide a smooth flow of refrigerant in relation to a pulsating flow due to action by a piston of the compressor.

2. Background of the Related Art

The compressor in a refrigerator or an air conditioner compresses a low temperature and low pressure operating fluid through an evaporator into a high temperature and high pressure fluid. A prior art compressor in the refrigerator or the like will be explained with reference to the attached drawings.

Referring to FIG. 1, the prior art compressor is provided with a motor part 8 for receiving a current to generate a rotating force, and a compressor part 10 for compressing the refrigerant by the rotating force of the motor part, both of which are enclosed in a case 6 having an upper shell 2 and a lower shell 4. The motor part 8 has a stator 8*a* for receiving the current to generate an electromagnetic force, and a rotor 8*b* for generating a rotating force by the electromagnetic force. The compressor part 10 has a crank shaft 12 for rotating with the rotor 8*b*, a connecting rod 14 for converting a rotating movement of the shaft into a linear reciprocating movement, and a piston 18 for compressing refrigerant in a cylinder block 16 by means of the connecting rod. The connecting rod 14 has one end pin coupled to an eccentric piece 12*a* on top of the crank shaft 12, and the other end pin coupled to the piston 18, for converting the rotating movement of the crank shaft 12 into a linear reciprocating movement. The foregoing compressor operation may be summarized as follows. As the piston 18 makes a linear reciprocating movement in the cylinder block 16 at reception of a rotating movement of the crank shaft 12, the piston 18 converts a low temperature, low pressure refrigerant from the evaporator into a high temperature, high pressure refrigerant through a process of refrigerant suction, compression, and discharge, and supplies to a condenser (not shown). Since noise results inevitably from action of the piston 18 in the compressor, the refrigerant from the evaporator is passed through a suction muffler 20 before the refrigerant is introduced into the cylinder 15 for attenuation of noise. The suction muffler 20 will be explained with reference to the attached drawings. FIG. 2 illustrates a suction system and a discharge system of a prior art compressor having the suction muffler 20 provided therein schematically, and FIG. 3 illustrates a perspective sectional view of a related art suction muffler 20.

Referring to FIG. 2, in the process of refrigerant suction, the refrigerant is drawn into the cylinder 15 through a suction valve 31 until a pressure in the cylinder 15 becomes equal to a pressure in the suction muffler 20 as the piston 18 moves from a top dead center to a bottom dead center position. The refrigerant drawn into the cylinder 15 is compressed as the piston 18 moves from the bottom dead center to the top dead center, when the pressure in the cylinder 15 builds up until the pressure is higher than an elastic force of a discharge spring (not shown) which supports the discharge valve 32 when the discharge valve 32 is opened, to discharge a high pressure refrigerant through a discharge tube 36 from the cylinder 15 via a discharge plenum 34. Since such a reciprocating movement of the piston 18 is repeated for 60 times per a second in a case of a 60 Hz compressor, there are 1/60 sec cycle repetitive pulsations in the suction muffler 20 and the discharge plenum 34 caused by such repetitive suction and discharge.

Referring to FIG. 3, the suction muffler 20 has an inlet 22 for introducing the refrigerant into the suction muffler 20, a chamber 24 for temporary storage of the refrigerant, a refrigerant supply tube 26 for leading the refrigerant from the chamber 24 to a suction valve (see FIG. 2) of the cylinder, and Helmholtz resonator 28 for attenuating noise of a specific frequency. As shown, the refrigerant is involved in a sequential pressure drop as the refrigerant passes through a number of chambers 24*a* and 24*b* and a chamber connection tube 25 after the refrigerant is introduced through the inlet 22, and attenuation of the specific frequency as the refrigerant passes through the Helmholtz resonator 28.

However, the pulsation of the connection tube 25 between the chambers 24 and the refrigerant supply tubes 26 coming from the pulsation of the suction muffler 20 impedes a m uniform supply of the refrigerant, to cause a deterioration of performance, and, sometimes reverse flow of the refrigerant owing to a reverse pressure gradient formed by the non-uniform pulsation of the refrigerant.

SUMMARY OF THE INVENTION

Accordingly, the present invention is directed to a suction muffler for a compressor that substantially obviates one or more of the problems due to limitations and disadvantages of the related art.

An object of the present invention is to provide a suction muffler for a compressor, which can increase a refrigerant supply pressure, which increases an amount of refrigerant introduced into a cylinder, that improves a performance of the compressor.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the suction muffler for a compressor includes an inlet for introducing a refrigerant into the suction muffler, a chamber for temporary storage of the refrigerant and dropping a pressure of the refrigerant by means of a sudden increase of a volume of the refrigerant, a resonator for attenuating a noise of a specific frequency, a refrigerant supply tube for leading the refrigerant from the chamber to a cylinder, thereby stopping transmission of a pulsating flow resulting from the piston movement in the cylinder to the outside of the refrigerant supply tube and preventing transmission of a noise from a suction valve and a discharge valve to outside of the suction muffler, wherein the chamber includes a vibration member having a vibration frequency corresponding to a pulsation frequency which occurs at the refrigerant supply tube.

The vibration member is a vibration plate or a bellows.

The vibration plate includes a coil spring, and the bellows includes an elastic member.

The vibration member has a specific vibration frequency in reaction to the vibration frequency of the pulsating flow at least even numbered times (2 times, 4 times, 6 times, . . . ) of the pulsating flow.

The vibration member is made to maintain the specific vibration frequency by an external vibration maintaining means.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. A suction muffler for a compressor in accordance with one preferred embodiment of the present invention includes an inlet for introducing a refrigerant into the suction muffler, a chamber for temporary storage of the refrigerant and reducing the pressure of the refrigerant by means of a sudden increase of a volume of the refrigerant, a resonator for attenuating a noise of a specific frequency, a refrigerant supply tube for leading the refrigerant from the chamber to a cylinder, for stopping transmission of a pulsating flow resulting from the piston movement in the cylinder to outside of the refrigerant supply tube and preventing transmission of a noise from a suction valve and a discharge valve to outside of the suction muffler, wherein the chamber includes a vibration member having a vibration frequency corresponding to a pulsation frequency occurring at the refrigerant supply tube. The vibration member is a vibration plate or a bellows.

Figure 1:
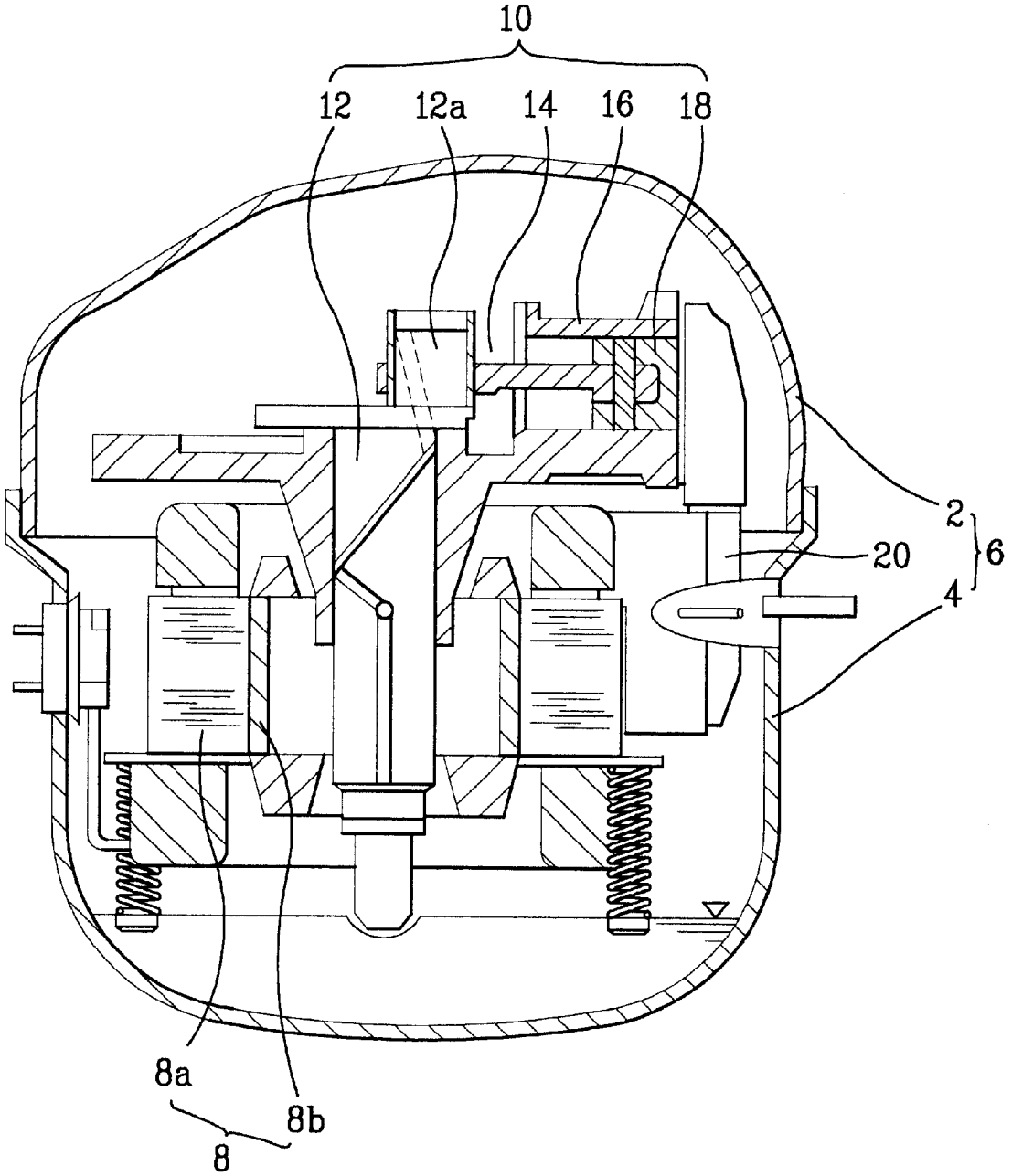
FIG. 1 Related Art
FIG. 1 illustrates a section showing a prior art compressor, schematically.
Figure 2:
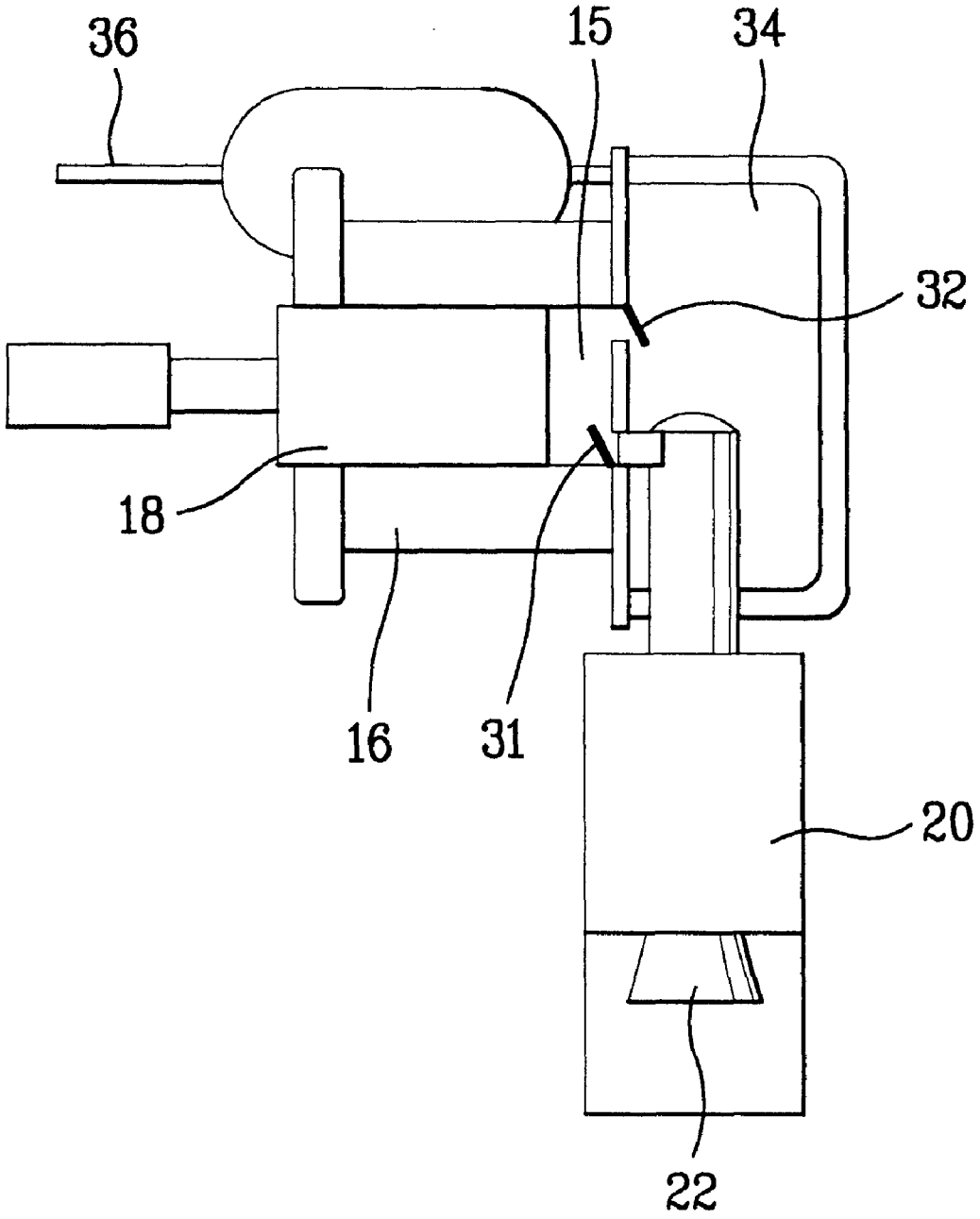
FIG. 2 Related Art
FIG. 2 illustrates a suction system and a discharge system of a prior art compressor, schematically.
Figure 3:
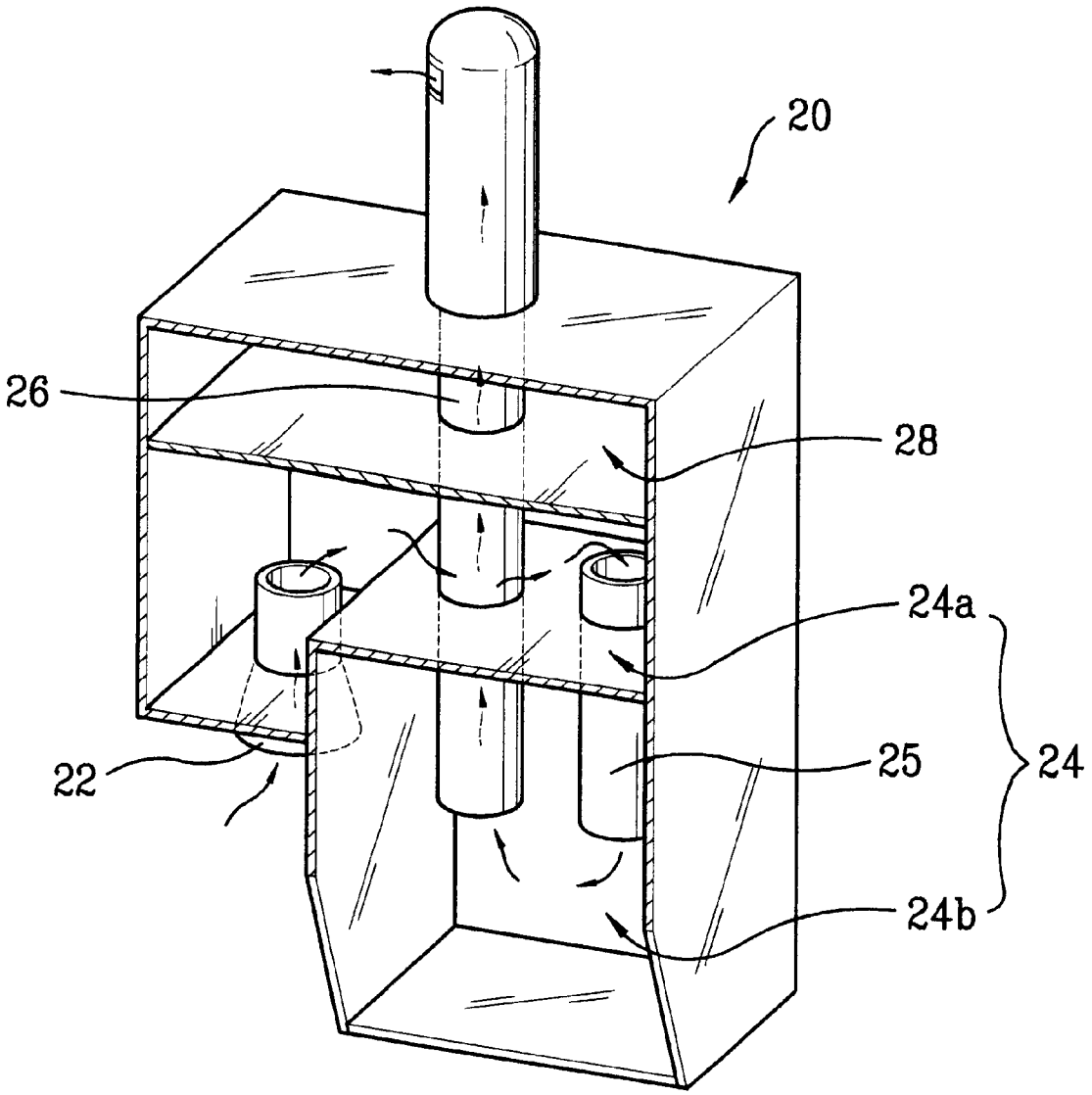
FIG. 3 Related Art
FIG. 3 illustrates a cut away perspective view of a prior art suction muffler.
Figure 4:
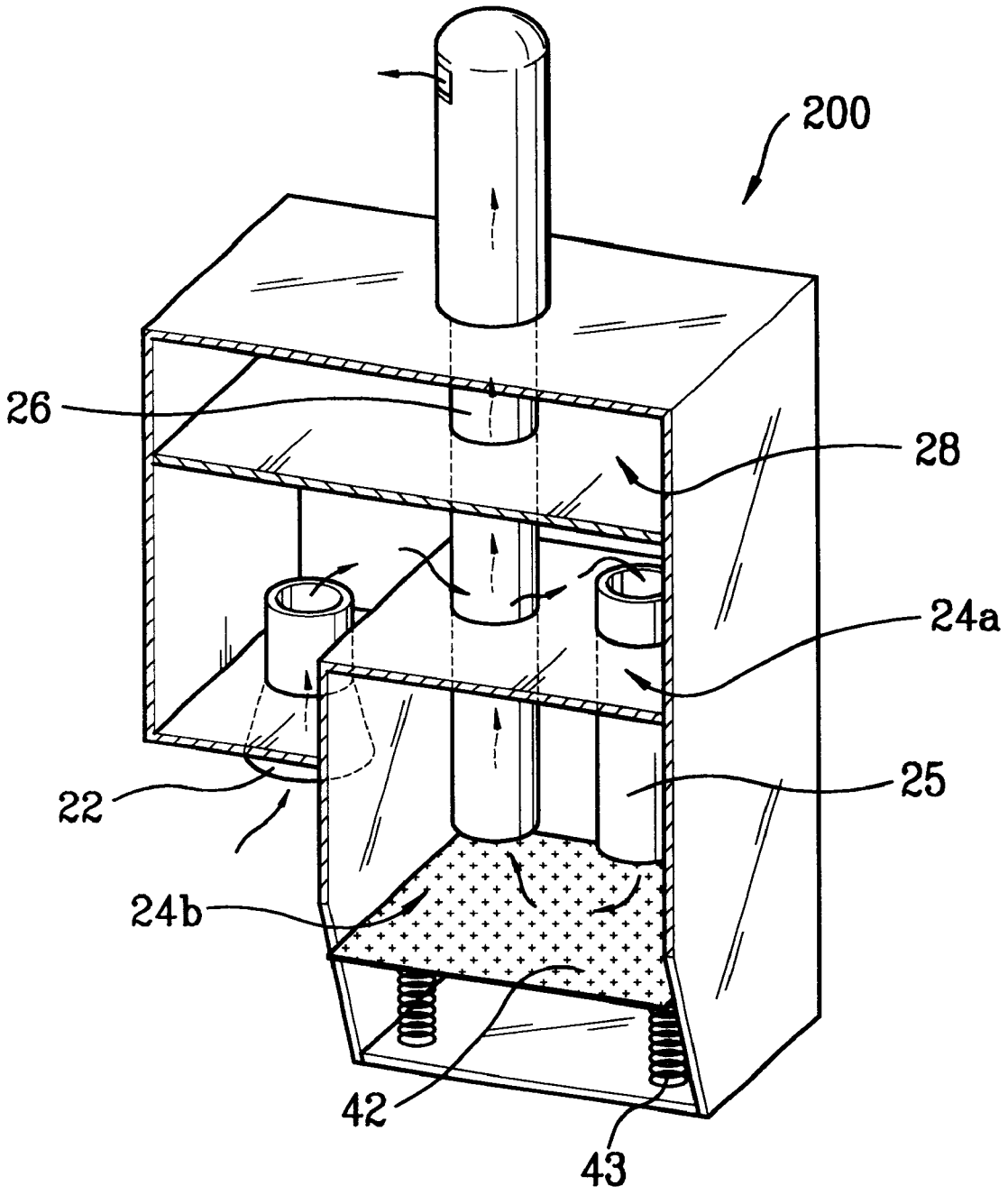
FIG. 4 illustrates a cut away view of a suction muffler for a compressor in accordance with one preferred embodiment of the present invention; and, FIG. 5 illustrates a perspective sectional view of the suction muffler having a bellows applied as a vibration member thereto in accordance with another preferred embodiment of the present invention.

The present invention will be explained in more detail, with reference to the attached drawings. Components of the present invention identical to the related art will be given the same reference numerals. FIG. 4 illustrates a cut away view of a suction muffler for a compressor in accordance with one preferred embodiment of the present invention.

Figure 6:
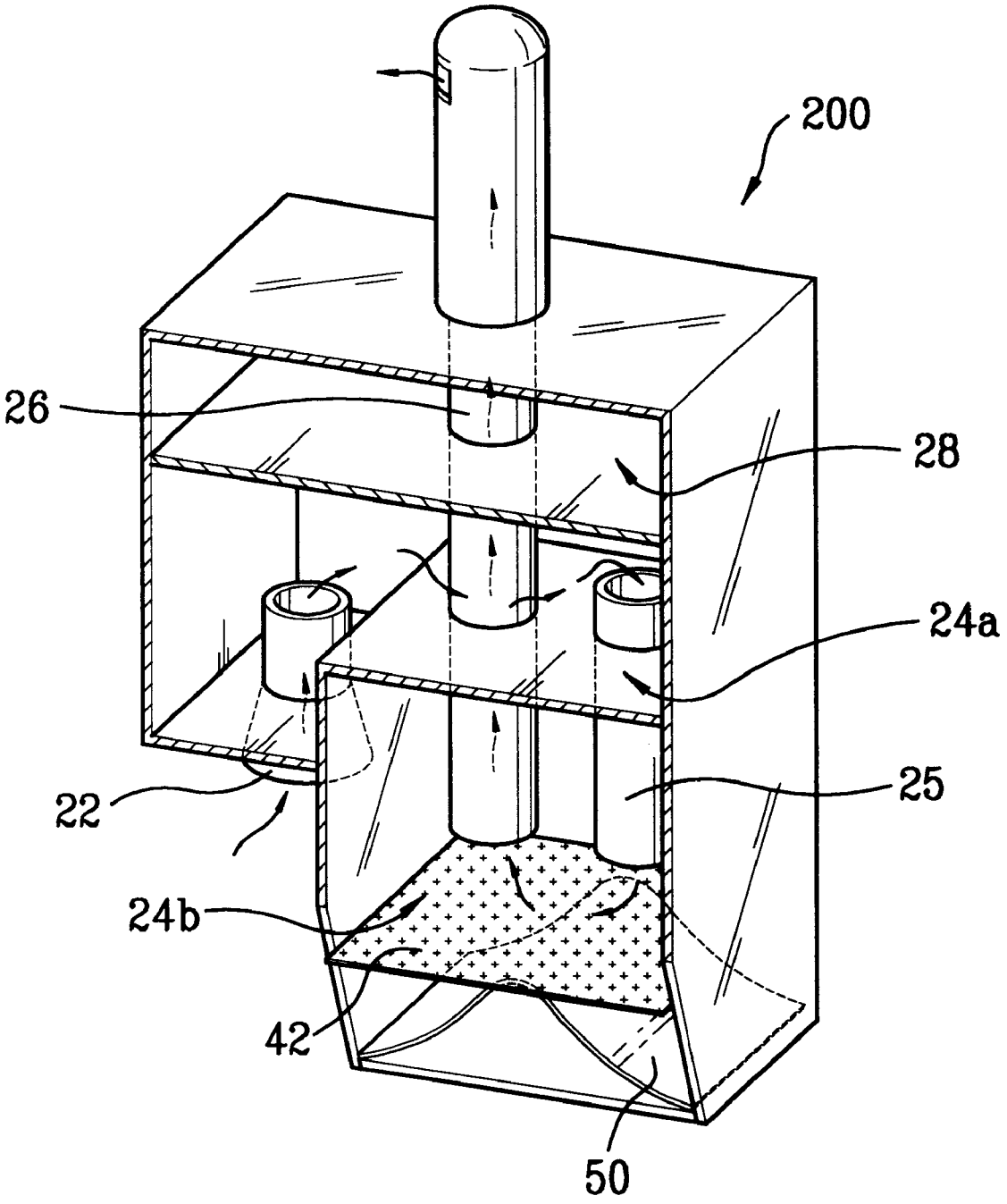
FIG. 6 illustrates a perspective sectional view of the suction muffler in accordance with another preferred embodiment of the present invention.

Referring to FIG. 4, the suction muffler for a compressor in accordance with one preferred embodiment of the present invention includes an inlet 22 for introducing a refrigerant from an evaporator into the suction muffler, a first chamber 24*a* and a second chamber 24*b* each for temporary storage of the refrigerant, a connection tube 25 for connecting the first chamber 24*a* and the second chamber 24*b*, a refrigerant supply tube 26 for leading the refrigerant from the first and second chambers 24*a* and 24*b* to a cylinder, a resonator 28 for attenuating a noise of a specific frequency, and a vibration member having a vibration frequency. Though two chambers are shown in this embodiment, the number of chambers may be increased/decreased. The vibration member employed in this embodiment is a vibration plate 42 made to have a vibration frequency corresponding to a pulsation of flow for itself. It is preferable that an elastic member is employed as the vibration plate 42, and a coil spring is employed as elasticity supplementary means. It is also preferable that additional means for forcibly adjusting the vibration frequency of the vibration member so that the vibration frequency of the vibration member is maintained at a fixed vibration frequency, i.e., vibration maintaining means 50, is employed. See FIG. 6. The vibration plate 42 is fitted to a lower portion of the second chamber 24*b* which has the greatest volume of the chambers 24*a* and 24*b*. The second chamber 24*b* connected to the refrigerant supply tube 26 directly for flow of the refrigerant, expanded in the first chamber 24*a* at first and expanded in the second chamber 24*b* and finally, toward the cylinder 15.

The operation of the suction muffler 200 in accordance with a preferred embodiment of the present invention will be explained.

The low temperature and low pressure refrigerant passed through the evaporator (not shown) is introduced into the compressor through the inlet 22. A path of the refrigerant is indicated by arrows in FIG. 4. As the refrigerant, a refrigerant of ammonia, freon, or methylchloride group is used, which is a gas susceptible to liquefaction /evaporation. The refrigerant passed through the inlet is introduced into the first chamber 24*a*. The refrigerant gas subjected to a pressure drop for the first time in the first chamber 24*a* is introduced into the second chamber 24*b*, and is involved in pressure and temperature drop with an attenuation of noise for the second time as the refrigerant is involved in a sharp volumetric expansion in the second chamber 24*b*. Then, the refrigerant gas flows to the suction valve 31 through the refrigerant supply tube 26. The refrigerant gas is involved in a significant reduction of noise of a specific frequency as the refrigerant gas passes through the Helmholtz resonator 28 in the middle of moving through the inside of the refrigerant supply tube 26. During the foregoing process, there is a periodic compressive flow, similar to a human body, between the connection tube 25 and the refrigerant supply tube 26 in the second chamber 24*b* by the piston movement inside of the cylinder, which is called pulsation, of which detailed explanation will be omitted herein as the pulsation is already explained in the prior art in detail. As the pulsation occurs, the vibration plate 42 fitted to the lower portion of the second chamber 24*b* begins to have a vibration frequency corresponding to the pulsation by an appropriate adjustment of material and size of the vibration plate 42. The vibration plate 42 of this embodiment is designed to have a vibration frequency two times the vibration frequency of the pulsation. According to this, the vibration plate 42 can increase a supply of the refrigerant to the cylinder 15 significantly according to a supercharging effect as the vibration plate 42 increases supply of the refrigerant to the refrigerant supply tube 26 to make up for pressure drop which occurs up to the second chamber 24*b* along the refrigerant supply tube 26 when the refrigerant flows into the cylinder 15 at the time the piston 18 reaches the bottom dead center. Even if the vibration plate 42 is operative not in two times, but even numbered times, such as 4 times and 6 times, of the operation frequency of the piston 18, the increased refrigerant supply to the cylinder 15 is available as the vibration plate 42 will move toward the refrigerant supply tube 26 if there is pressure drop in the refrigerant supply tube 26, that allows the supercharging effect to be attained.

Figure 5:
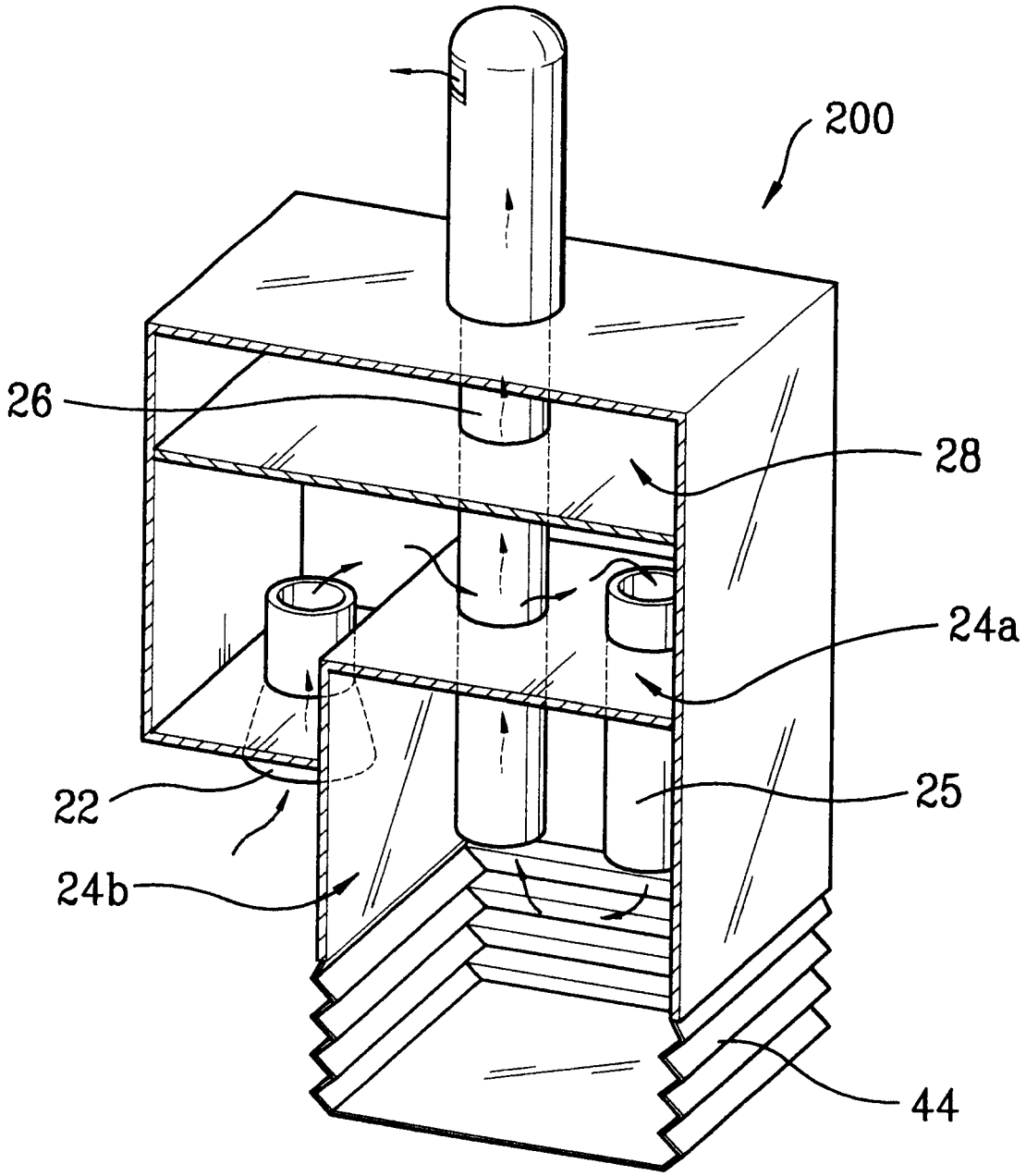

FIG. 5 illustrates a perspective sectional view of the suction muffler having a bellows applied as a vibration member thereto in accordance with another preferred embodiment of the present invention.

Referring to FIG. 5, the suction muffler 20' of this embodiment has a system identical to the embodiment shown in FIG. 4 except that the bellows 44 is used as the vibration member to cope with the pulsation. The suction muffler 200' of the compressor having the bellows 44 employed therein can be made either to have a specific vibration frequency for itself in correspondence to the pulsation by the piston movement, or to be maintained at the specific vibration frequency by providing external vibration maintaining means 50 thereto. Since the operation and effect of refrigerant supply increase in correspondence to the pulsation in the suction muffler 200' having the bellows 44 employed therein is almost identical to the suction muffler 200 having the vibration plate employed therein in the foregoing embodiment, a detailed explanation will be omitted. The bellows 44 formed of an elastic material can enhance a vibration effect. The vibration member may be provided with a coil spring under the vibration plate 42 shown in FIG. 4, for adjusting a vibration effect appropriately, to maximize a pressure transmission effect to the refrigerant supply tube.

It will be apparent to those skilled in the art that various modifications and variations can be made in the suction muffler for a compressor of the present invention without departing from the spirit or scope of the invention. Thus, it is intended that the present invention cover the modifications and variations of this invention provided they come within the scope of the appended claims and their equivalents.

What is claimed is:

1. A suction muffler for a compressor comprising:

an inlet for introducing a refrigerant into the suction muffler;

a chamber for temporary storage of the refrigerant and dropping a pressure of the refrigerant by means of a sudden increase of a volume of the refrigerant;

a resonator for attenuating a noise of a specific frequency;

a refrigerant supply tube for leading the refrigerant from the chamber to a cylinder, thereby stopping transmission of a pulsating flow occurred by the piston movement in the cylinder to outside of the refrigerant supply tube and preventing transmission of a noise from a suction valve and a discharge valve to outside of the suction muffler, wherein the chamber includes a vibration member having a vibration frequency corresponding to a pulsation frequency occurred at the refrigerant supply tube.

2. A suction muffler for a compressor comprising:

an inlet for introducing a refrigerant into the suction muffler;

a chamber for temporary storage of the refrigerant and dropping a pressure of the refrigerant by means of a sudden increase of a volume of the refrigerant;

a resonator for attenuating a noise of a specific frequency;

a refrigerant supply tube for leading the refrigerant from the chamber to a cylinder, thereby stopping transmission of a pulsating flow occurred by the piston movement in the cylinder to outside of the refrigerant supply tube and preventing transmission of a noise from a suction valve and a discharge valve to outside of the suction muffler, wherein the chamber includes a vibration member having a vibration frequency corresponding to a pulsation frequency occurred at the refrigerant supply tube, said vibration member comprising a vibration plate.

3. A suction muffler for a compressor comprising:

an inlet for introducing a refrigerant into the suction muffler;

a chamber for temporary storage of the refrigerant and dropping a pressure of the refrigerant by means of a sudden increase of a volume of the refrigerant;

a resonator for attenuating a noise of a specific frequency;

a refrigerant supply tube for leading the refrigerant from the chamber to a cylinder, thereby stopping transmission of a pulsating flow occurred by the piston movement in the cylinder to outside of the refrigerant supply tube and preventing transmission of a noise from a suction valve and a discharge valve to outside of the suction muffler, wherein the chamber includes a vibration member having a vibration frequency corresponding to a pulsation frequency occurred at the refrigerant supply tube, wherein said vibration member comprises a bellows.

4. A suction muffler as claimed in claim 3, wherein said bellows includes an elastic member.

5. A suction muffler as claimed in claim 2, wherein said vibration plate includes a coil spring.

6. A suction muffler as claimed in any one of claim 1, 2, 5, 3 or 4, wherein the vibration member has a specific vibration frequency in reaction to the vibration frequency of the pulsating flow.

7. A suction muffler as claimed in claim 6, wherein the vibration member has a vibration frequency at least even numbered times of the pulsating flow.

8. A suction muffler as claimed in any one of claim 1, 2, 5, 3 or 4, wherein the vibration member maintains the specific vibration frequency by an external vibration maintaining means.

9. A suction muffler as claimed in claim 8, wherein the vibration member has a vibration frequency at least even numbered times of the pulsating flow.

* * * * *